United States Patent [19]

Ingram et al.

[11] Patent Number: 4,964,513

[45] Date of Patent: Oct. 23, 1990

[54] PACKAGE

[75] Inventors: Gaylynn F. Ingram, Rochester; Evan W. Hutchison, Honeoye Falls, both of N.Y.

[73] Assignee: Eastman Kodak Company, Rochester, N.Y.

[21] Appl. No.: 482,423

[22] Filed: Feb. 20, 1990

[51] Int. Cl.[5] ..... B65D 65/40

[52] U.S. Cl. ..... 206/459; 206/407

[58] Field of Search ..... 206/459, 534, 407, 389

[56] References Cited

U.S. PATENT DOCUMENTS

| | | | |
|---|---|---|---|
| 3,171,561 | 3/1965 | MacLean | 215/41 |
| 3,285,451 | 11/1966 | Golde | 215/40 |
| 3,292,807 | 12/1966 | Golde | 215/7 |
| 3,726,030 | 4/1973 | Wilson | 206/459 X |
| 4,616,750 | 10/1986 | Nouwen | 206/459 |
| 4,639,386 | 1/1987 | Akao | 428/35 |
| 4,702,383 | 10/1987 | Wender | 215/232 |

FOREIGN PATENT DOCUMENTS

| | | | |
|---|---|---|---|
| 2528395 | 12/1983 | France | 206/459 |
| 1113235 | 7/1989 | Japan . | |
| 1113237 | 7/1989 | Japan . | |
| 2213135 | 8/1989 | United Kingdom . | |

*Primary Examiner*—William I. Price

*Attorney, Agent, or Firm*—William C. Dixon

[57] ABSTRACT

A cartonless recyclable package for protectively enclosing a product, such as photographic film, comprises a recyclable plastic container and mating cap with recyclably compatible plastic labels thereon bearing product information. One such label on the cap has readily tearable tab portions extending therefrom and tautly secured to the container, to tear apart when the cap is first removed. A second label, secured to the container and overlapping the tearable tab portions, includes inner and outer sheets separably adhered together. The outer sheet can be peeled back to reveal information on the interfacing surfaces of both sheets, and then re-adhered to the inner sheet. A third label, separably adhered to the first label on the cap, may be peeled away and re-adhered to some other surface for reference after the product has been removed. A thumb tab on the cap, to facilitate cap removal, is used also to orient the container and cap for appropriate placement of the labels, and to orient the resulting package in a cooperating displaying and dispensing device. That device comprises an upstanding, open-ended, transparent, tubular chute having a longitudinal slot extending down a rear side thereof and configured to receive the package through its open top end, with the thumb tab projecting rearwardly through the slot, thereby orienting the package labels to face forwardly in a desired display direction. The package is gravity-fed to the open bottom end, where it is supported and oriented for convenient removal.

10 Claims, 7 Drawing Sheets

FIG. 6
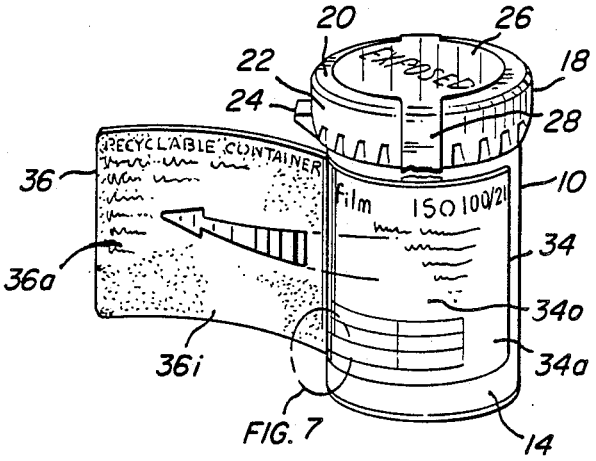
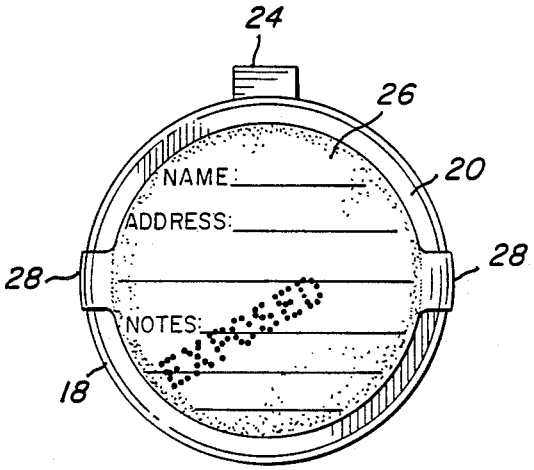
FIG. 5
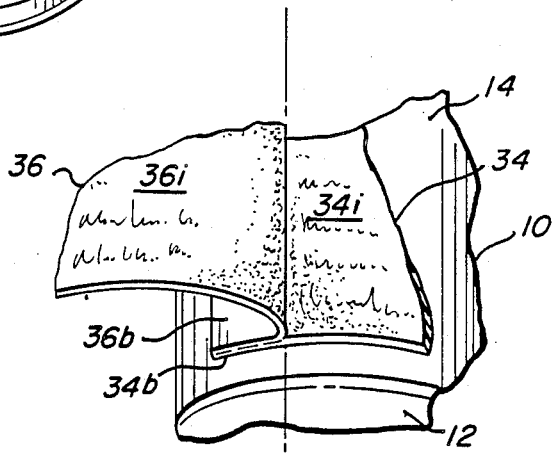
FIG. 7

PACKAGE

CROSS-REFERENCE TO RELATED APPLICATIONS

Reference is made to commonly assigned, copending, related U.S. patent application Ser. No. 482,448, titled RECYCLABLE PACKAGE, Ser. No. 482,422, titled TAMPER-EVIDENT PACKAGE, Ser. No. 482,371, titled PACKAGING METHOD, and Ser. No. 482,149, titled PACKAGE DISPENSER, all filed concurrently herewith on Feb. 20, 1990.

BACKGROUND OF THE INVENTION

1. Field of the Invention

The present invention relates generally to product packaging, particularly to such packaging having reduced packaging material but adequate product information thereon, and more particularly to such packaging suitable for protectively enclosing a photosensitive product.

2. Description of the Prior Art

Illustrative of the type of packaging to which this invention relates are the following documents:

U.S. Pat. No. 4,639,386 (Akao)—Discloses a resilient plastic cylindrical can having an open end defined by a beaded rim and a mating circular cap that fits closely over and around the rim to close that end and thereby portectively contain a photographic film cartridge. U.K. Published Patent Application No. GB-2,213,135-A (Fuji)—Discloses a film package comprising a plastic container with an open end or side and a removable or hingedly attached cap, for opening and closing the container around a 35 mm film cartridge, wherein an information-displaying label may be attached to the container's outer surface, a seal may extend from the container to the cap to indicate whether the package has been opened, and a lug or tab may project from an edge of the cap to facilitate opening.

While protective packages such as those referred to above may have sufficed for their intended purposes, there is now an increasing need for product packages having a reduced amount of discardable packaging material but still providing fully adequate and conveniently usable product information. That need heretofore has not been satisfactorily met.

SUMMARY OF THE INVENTION

Accordingly, a primary object of this invention has been to meet the foregoing need, and to do so in a highly efficient and effective manner. That and other objects have been achieved by the invention herein claimed.

This invention finds particular utility in a package for protectively enclosing a product, the package including a container having an access opening through which the product is insertable into and removable from the container and a movable closure matable with the opening to close and open the container, the container and the closure each having an outward-facing exterior surface. a label disposed on the exterior surface of one or both of the container and closure, for displaying information relating to the product, includes a sheet-like inner portion having an inner surface facing toward and secured to said exterior surface and an outer surface facing away from said exterior surface. The label also includes a sheet-like outer portion superposed upon the inner portion, the outer portion having an inner surface facing toward and separably adhered to the inner-portion outer surface and an outer surface facing away from the inner portion. The inner-portion outer surface and the outer-portion inner and outer surfaces each have some of the aforesaid information presented thereon. The outer portion is at least partially separable from the inner position so that such information on the inner-portion outer surface and the outer-portion inner surface can be conveniently viewed.

This invention, and its objects and advantages, will become more apparent in the detailed description of the preferred embodiment thereof presented below.

BRIEF DESCRIPTION OF THE DRAWINGS

In the detailed description of the preferred embodiment of this invention presented below, reference is made to the accompanying drawings, wherein like reference characters denote like elements, and wherein:

FIG. 5 is a top-plan view similar to FIG. 4, somewhat enlarged and depicting the inner top label remaining after the outer top label has been removed;

FIG. 6 is a perspective view of the film package shown in FIG. 5, illustrating an outer side label thereon bein peeled back and revealing an inner side label thereunder;

FIG. 7 is an enlarged fragmentary view of the circled portion of FIG. 6 but depicting a modification of the side labels there shown;

DESCRIPTION OF THE PREFERRED EMBODIMENT

Because certain parts of product packaging arrangements, methods of assembling them, and devices for displaying and dispensing them, are well known, the following description is directed in particular to those elements and steps forming, cooperating directly with, or relating especially to, this invention. Elements and steps not specifically shown or described herein are selectable from those known in the pertinent art.

Figure 1:
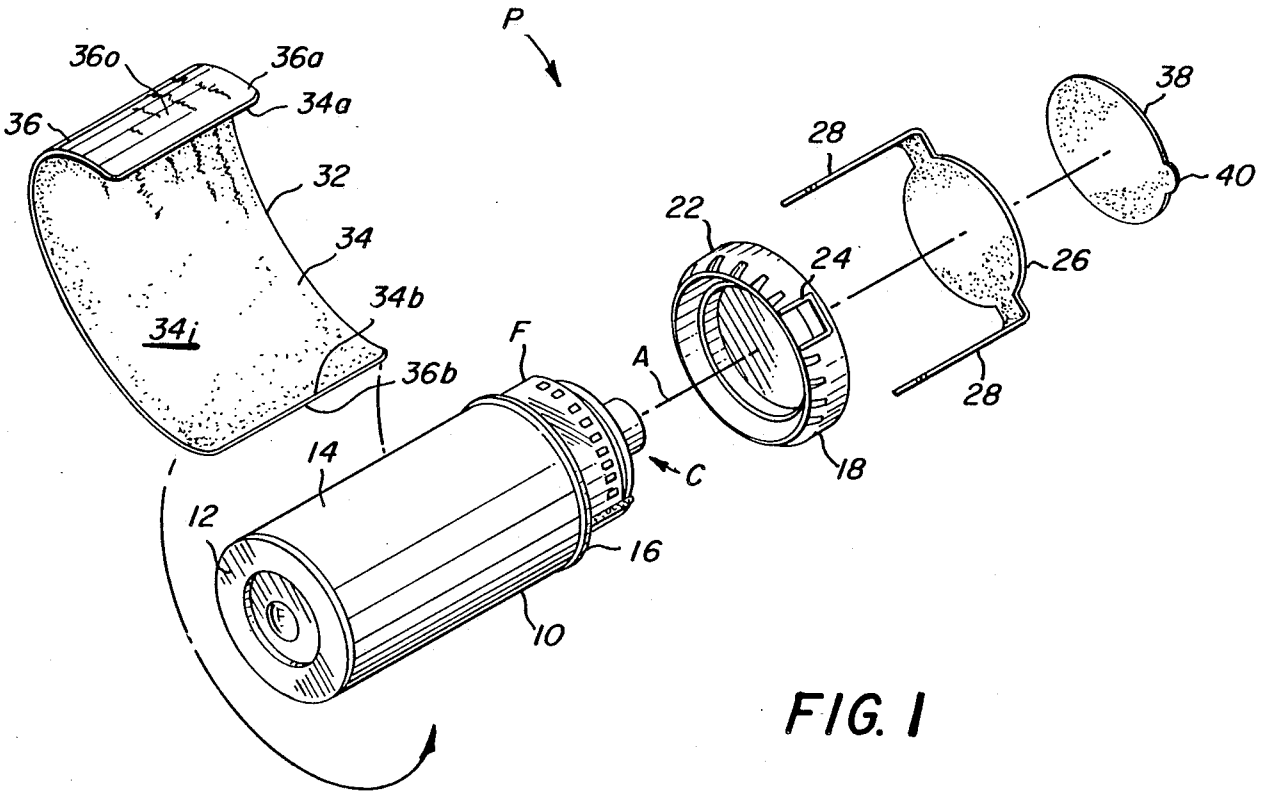
FIG. 1 is an exploded perspective view of a package constructed and configured, in accordance with the preferred embodiment of this invention, to protectively enclose a cartridge of photographic roll film.

FIG. 1 illustrates, via an exploded perspective view, a package P constructed and configured, in accordance with the preferred embodiment of this invention, to protectively enclose a cartridge C of photograhic roll film F, such as color print film in the popular 35 mm size.

Figure 3:
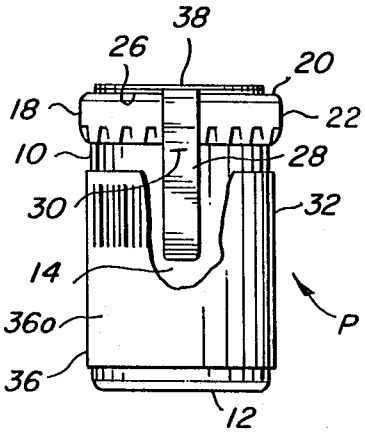
FIG. 3 is a side-elevational view, partially broken away, of the film package shown in FIG. 2.
Figure 4:
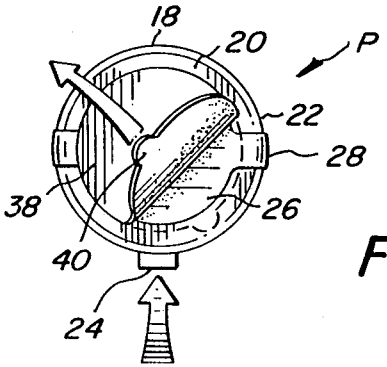
FIG. 4 is a top-plan view of the film package shown in FIG. 3, illustrating an outer top label thereon being peeled away and revealing part of an inner top label thereunder.
Figure 2:
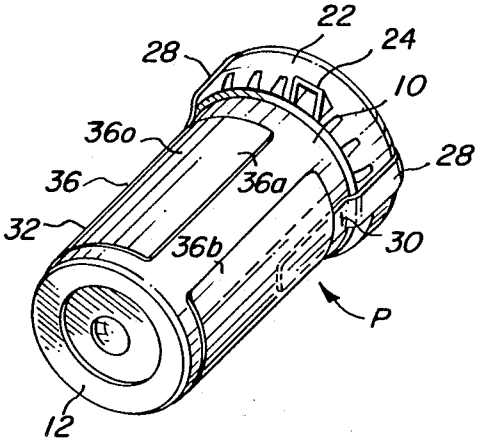
FIG. 2 is an assembled perspective view of the film package shown in FIG. 1.

Package P comprises a substantially cylindrical, or can-shaped, container 10 having a closed bottom end 12, an exterior sidewall surface 14, and an open top end 16, through which film cartridge C is insertable and removable. Attachable to and detachable from end 16, to respectively close and open container 10, is a closure in the form of a mating end cap 18, which fits closely over and around end 16 in a light-tight manner. Container 10 and cap 18 are both made of an opaque plastic material, such as polyethylene, which is readily recyclable. Cap 18 has a substantially round exterior end wall surface 20 and a peripheral exterior sidewall surface 22 depending therefrom as shown in FIGS. 2–4. Projecting radially outward from one side of peripheral sidewall surface 22 is a thumb tab 24 to facilitiate pushing cap 18 away from end 16, and to serve other important purposes to be discussed hereinbelow.

A first label 26, mainly round in configuration, has a pair of elongate, flexible, and readily tearable tab portions 28 extending respectively from opposite sides thereof and bent downwardly therefrom as shown in FIG. 1. Label 26 is adhesively secured to the exterior end wall surface 20 of cap 18, while tab portions 28 are wrapped over and secured to respective sides of the exterior sidewall surface 22 of cap 18. With the cap firmly attached to the container top end 16, the tab portions 28 are then tautly secured to corresponding opposite sides of the exterior sidewall surface 14 of container 10 as shown in FIG. 3. Each tab portion 28 is provided with a small slit 30 at approximately the location thereon where the tab portion leaves the cap, as shown in FIGS. 2 and 3, to render the tab portion more easily tearable whenever the cap is pushed upwardly to open the container. FIG. 6 illustrates one of the tab portions having been so torn.

A second label 32, basically rectangular in shape, is adhesively secured to the exterior sidewall surface 14 of container 10, over the tearable tab portions 28, thereby further securing the tab portions to the container sidewall. Label 32 comprises substantially coextensive and registered inner and outer sheet-like portions 34 and 36 respectively. Inner portion 34 has first and second ends **34*a* and 34*b* respectively, an inner surface 34*i* facing toward and adhesively secured to sidewall surface 14, and an outer surface 34*o* facing away from surface 14. Superposed outer portion 36 has corresponding first and second ends 36*a* and 36*b* respectively, an inner surface 36*i* facing toward and separably adhered to inner-portion outer surface 34*o*, and an outer surface 36*o* facing away from the inner portion. The inner-portion outer surface 34*o* and the outer-portion inner and outer surfaces 36*i* and 36*o* all have product information thereon. Such information presented on outer surface 36*o* is fully visible when the inner and outer portions are registered as shown in FIGS. 2 and 3. To render such information on surfaces 34*o* and 36*i* viewable, outer portion 36 is at least partially separable from inner portion 34. Thus, starting at its first end 36*a* outer portion 36 is readily peelable away from inner portion 34 toward its second end 36*b*, but is firmly secured to the inner portion at its second end to prevent the outer portion from being removed entirely. FIGS. 6 and 7 illustrate the outer portion 36 peeled back from inner portion 34 almost to their registered second ends 34*b* and 36*b*. Consistent with the purpose of keeping the outer portion on the container, its inner surface 36*i* is adapted to be separably re-adhered to surface 34*o* when superposed thereupon again after being peeled away to view the product information thereon. Preferably, label 32 is formed as two distinct, coextensive, sheet-like elements comprising its inner and outer portions 34 and 36 brought together in registered face-to-face relation as aforesaid and firmly secured at their second ends 34*b* and 36*b*. Alternatively, label 32 could be formed as a unitary sheet-like element folded over upon itself at a medial fold line thereon defining the joined second ends 34*b* and 36*b* of its coextensive, registered inner and outer portions, as illustrated partially in FIG. 7**.

A third label 38, also mainly round, is separably adhered to the top surface of first label 26. With the help of a peripheral pull tab 40, label 38 is readily peelable away from label 26, as illustrated in FIG. 4, and is readherable to another surface, such as an exterior surface on the user's camera, for reference in reminding the user of the particular product removed from the container. As depicted in FIGS. 4–6, removal of label 38 leaves label 26 remaining on cap 18. The now-exposed top surface of label 26 may provide information relating to the product, such as the status of an exposed film cartridge returned to the container, as well as spaces wherein the user can record his own information.

An especially advantageous feature of all three of labels 26, 32, and 38 is that they are made of recyclable plastic material that is recyclably compatible with the recyclable plastic material, such as polyethylene, of which the container and cap are made. This feature extends as well to the adhesive used on their adhering surfaces, and to the inks used on their information surfaces. With this feature, the entire package (without the product therein) can be recycled as a whole, without first having to remove the labels.

In assembling the package P just described, after film cartridge C has been fully inserted into container 10 through open top end 1l thereof, end cap 18 is first attached to end 16 to close container 10. Using the outwardly projecting thumb tab 24 as an orienting guide, the joined container and cap are then placed in a predetermined angular position relative to their longitudinal axis A.

Next, with the container and cap held in that position, the first label 26 is adhesively secured to the cap exterior end wall surface 20, and its oppositely extending tearable tab portions 28 are then folded downwardly over corresponding opposite portions of cap exterior sidewall surface 22 and container exterior sidewall surface 14, and are tautly secured thereto, so that label 26 and tab portions 28 are secured in a preselected angular orientation relative to thumb tab 24. In the preferred embodiment illustrated, that orientation is such that at least a principal part of the information borne by label 26 is readily viewable from a direction substantially opposite to the direction in which tab 24 projects outwardly from surface 22, and tab portions 28 are substantially equally spaced peripherally from tab 24, i.e., tab 24 is peripherally midway between tab portions 28. With that orientation, any upward force exerted upon tab 24 to remove cap 18 results in substantially equal upward tearing forces on tab portions 28 at the locations thereon where those portions have been weakened by the small slits 30.

The next step, with the container and cap still held in the aforementioned predetermined position, is to secure the second label 32 to the container exterior sidewall surface 14 over the depending tab portions 28 already secured thereto, and in the aforementioned angular orientation wherein at least a principal part of the information borne by label 32 is viewable from a direction substantially opposite to that in which tab 24 projects.

Assuming such information to be symmetrically displayed on label 32, this orientation would place the vertical centerline of label 32 diameterically opposite tab 24. As previously mentioned, applying label 32 over tab portions 28 further secures them to the container sidewall.

The final step, still with the container and cap in their predetermined position, is to separately adhere the third label 38 to the upward-facing exterior surface of first label 26, again in the aforementioned angular orientation, so that at least a principal part of the information borne by label 38 is viewable from the aforementioned direction opposite that in which tab 24 projects. With label 38 so oriented, according to the preferred embodiment depicted in FIG. 4, pull tab 40 projects radially outward approximately midway peripherally between thumb tab 24 and the closer one of tab portions 28.

With all three of labels 26, 32, and 38 applied in the same preselected angular orientation relative to thumb tab 24, when container 10 and can 18 are held in the desired predetermined angular position relative to their longitudinal axis A, at least the principal part of the information visible on each label can be viewed from a side of the package which is substantially diameterically opposite thumb tab 24. A particularly useful advantage of this arrangement will become readily apparent in the following description of a cooperating device for displaying and dispensing a pluarlity of such film packages.

Figure 8:
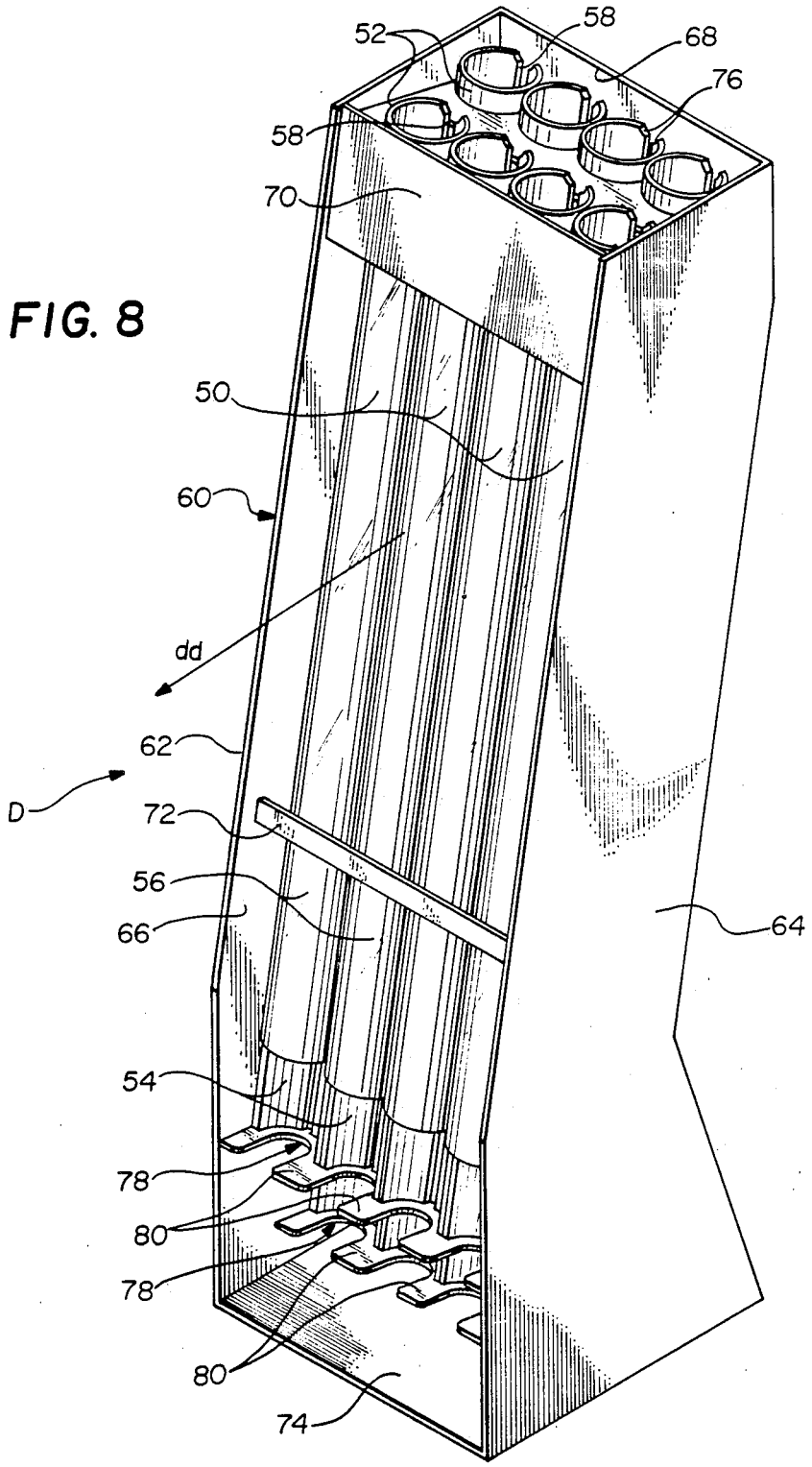
FIG. 8 is a perspective view of a device constructed and configured to display and dispense a plurality of product packages such as the film package shown in FIGS. 1–7.

FIG. 8 illustrates, in perspective, a point-of-sale device D constructed and configured to display and dispense a plurality of product-enclosing packages such as the film package P described above with reference to FIGS. 1–7.

in its illustrated embodiment, the device D comprises a plurality of upstanding tubes 50, each having upper and lower open end portions 52 and 54, respectively, and a substantially cylindrical sidewall 56 with a longitudinal slot 58 therein extending between the two end portions. Each tube 50 is configured to slidably receive therein a plurality of film packages P for successive gravity feeding from upper end portion 52 to lower end portion 54. Each package is received through the open end of portion 52 in such orientation that its end cap 18 faces upward, its thumb tab 24 projects radially in a first direction d1 into slot 58, and at least a principal part of visible information on its lablel 32 faces outwardly in a second direction d2 generally opposite the first direction d1 in which tab 24 projects.

The device D also comprises means 60 for supporting each tube 50 in an orientation wherein the second direction d2 coincides substantially with a display direction dd suitable for viewing. As depicted in FIG. 8, such means is provided by a partial enclosure 62 having opposing sidewalls 64 and 66, a rear wall 68, a short front panel 70 at its upper end, a front brace 72, and a bottom wall 74. Thus, as oriented by enclosure 62, the second direction d2 coincides with the desired display direction dd, which extends forwardly from each tube 50 while the tab-receiving slot 58 is disposed rearwardly therein. Also as oriented by enclosure 62, each tube is tilted so that its upper end portion 52 is slightly rearward of its upper end portion 54.

In the preferred embodiment illustrated, the cylindrical sidewall 56 of each tube is substantially transparent, so that at least the forward-facing portion of the label 32 on each package in the tube can be viewed therethrough.

Figure 11:
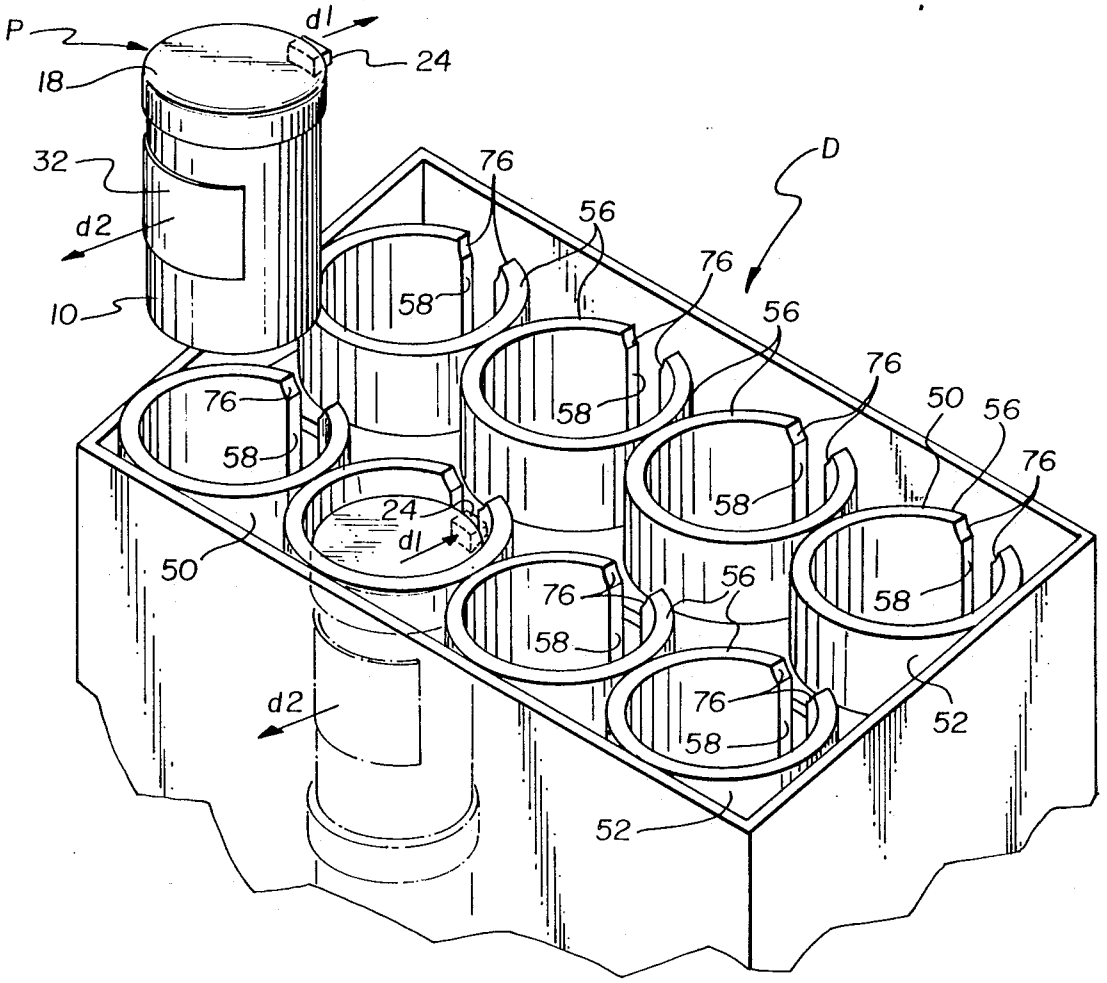
FIG. 11 is an enlarged, partial, top-perspective view of the device illustrated in FIG. 8, showing further details thereof.

As can be seen in FIGS. 8 and 11, the slot 58 in each tube is widened, or flared as at 76, at its open end in upper end portion 52 to facilitate receiving the package thumb tabs 24 therein.

Figure 9:
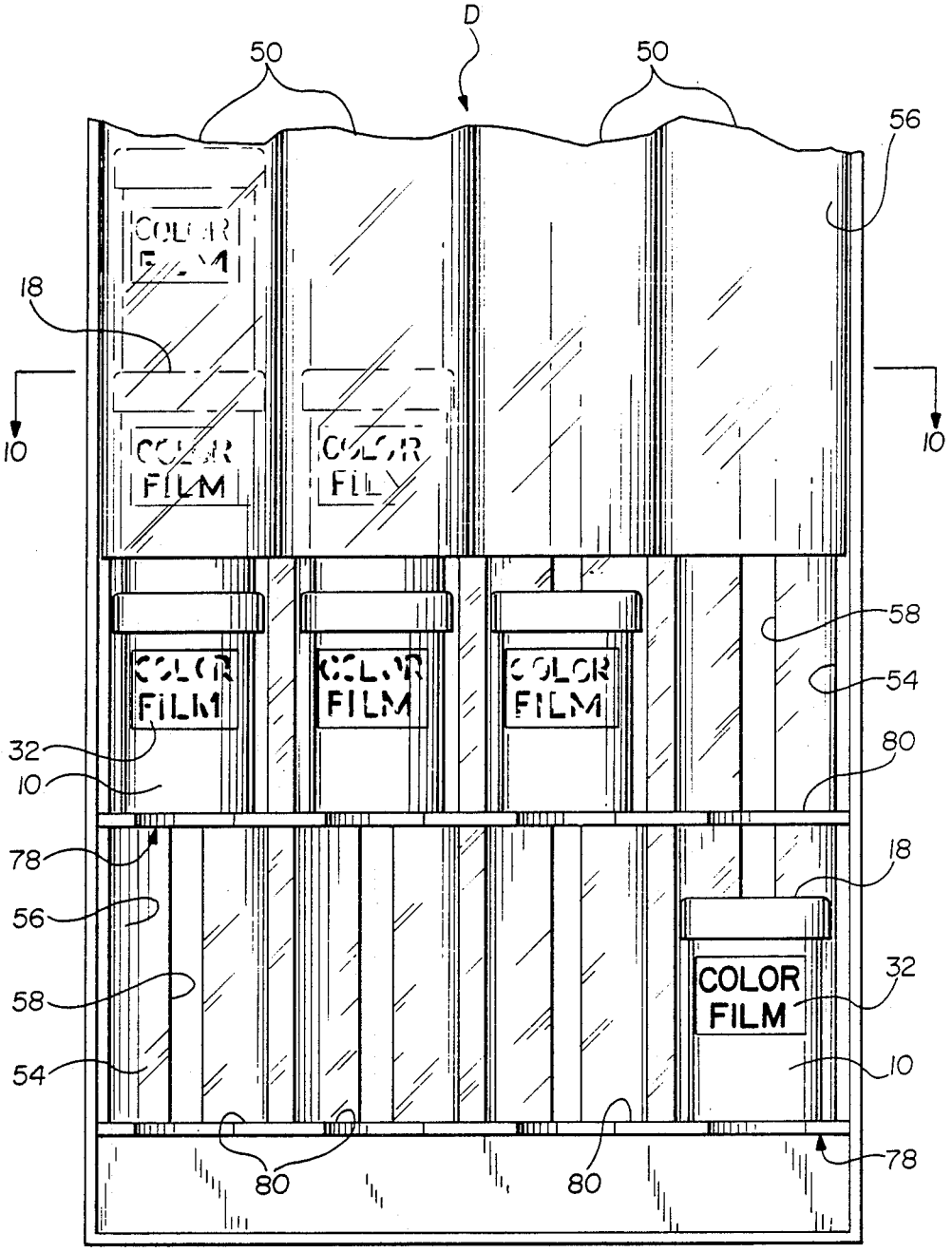
FIG. 9 is an enlarged, partial, front-elevational view of the displaying and dispensing device illustrated in FIG. 8.
Figure 10:
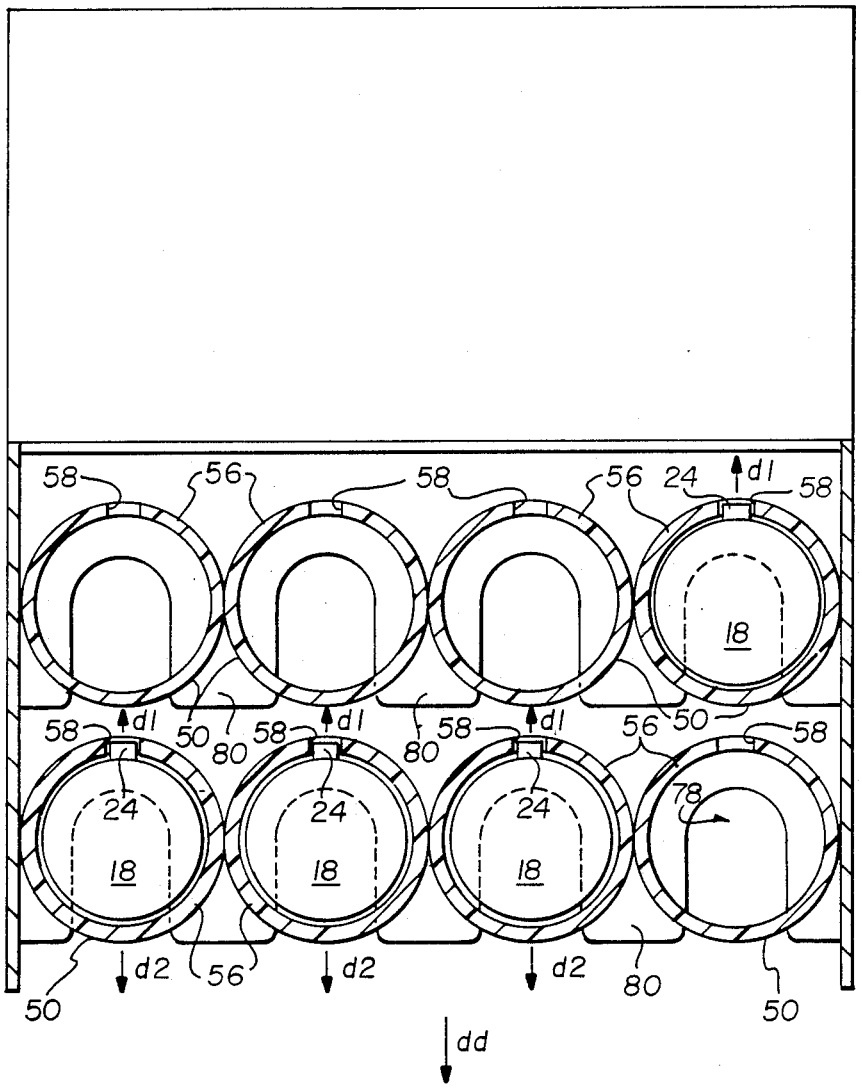
FIG. 10 is a cross-sectional view taken along line 10—10 in FIG. 9, showing internal details of the device there depicted.

Device D further comprises means 78 adjacent to the lower end portion 54 of each tube for supporting the lowermost one of the packages therein in such a way as to render the package accessible for convenient removal. As depicted in FIGS. 8 and 9, such means is provided by a substantially U-shaped shelf 80 disposed immediately under the open end of each lower end portion 54 and projecting forwardly therefrom. In supporting the lowermost package, shelf 78 of course serves to support all other packages stacked above that one. It will be noted that the front half of each lower end portion 54 is cut away to a height that permits the lowermost package to be readily grasped and removed, after which the next package above that one simply slides downward to take its place.

In the illustrated embodiment, the displaying and dispensing device D comprises a cluster of eight closely arranged tubes, including front and rear rows of four tubes each, disposed in side-by-side relation. It will be seen that the U-shaped shelves 78 under the four tubes in each row are joined together as one integrally formed piece. Also, it will be seen that the rear row of tubes extends to a lower level than the front row. Thus both the lower end portions 54 of the rear tubes and the joined shelves 78 thereunder are sufficiently below their front-row counterparts to render the lowermost packages in the rear row fully accessible for removal.

While the present invention has been described in detail with particular reference to its preferred embodiment as illustrated herein, it should be understood that variations and modifications can be effected within the spirit and scope of this invention.

We claim:

1. In a package for protectively enclosing a product, the package including a container having an access opening through which the product is insertable into and removable from the container and a movable closure matable with the opening to close and open the container, the container and the closure each having an outward-facing exterior surface, an improvement comprising a label disposed on the exterior surface of one of said container and closure for displaying information relating to the product, said label including a sheet-like inner portion having an inner surface facing toward and secured to said exterior surface and an outer surface facing away from said exterior surface, said label also including a sheet-like outer portion superposed upon said inner portion, said outer portion having an inner surface facing toward and separably adhered to said inner-portion outer surface and an outer surface facing away from said inner portion, said inner-portion outer surface and said outer-portion inner and outer surfaces each having some of said information presented thereon, said outer portion being at least partially separable from said inner portion so that said information on said inner-portion outer surface and outer-portion inner surface can be viewed.

2. A package improvement as claimed in claim 1 wherein each of said inner and outer portions has first and second opposite ends, and wherein said outer portion, when superposed upon said inner portion, is substantially coextensive therewith so that said outer-portion first and second ends are in registered overlying relation to said inner-portion first and second ends respectively.

3. A package improvement as claimed in claim 2 wherein said outer portion is readily peelable away from said inner portion from said first end toward said second end thereof, but is secured to said inner portion at said second end so that said outer portion is not removed entirely when peeled away from said inner portion to view said information on said inner-portion outer and outer-portion inner surfaces.

4. A package improvement as claimed in claim 3 wherein said outer-portion inner surface is adapted to be separately re-adhered to said inner-portion outer surface when superposed thereupon after being peeled away to view said information.

5. A package improvement as claimed in claim 4 wherein said label is formed as two distinct sheet-like elements comprising said inner and outer portions secured together at said second ends thereof.

6. A package improvement as claimed in claim 4 wherein said label is formed as a unitary sheet-like element folded over upon itself at a medial fold line thereon defining said second ends of said inner and outer portions.

7. A package improvement as claimed in claim 4 wherein said one of said container and closure is said container.

8. A package improvement as claimed in claim 4 wherein said one of said container and closure is said closure.

9. A package improvement as claimed in claim 4 wherein said label is made of plastic material.

10. A package improvement as claimed in claim 9 wherein said plastic material includes polyethylene.

* * * * *